US006073876A

United States Patent [19]

Suzuki et al.

[11] Patent Number: 6,073,876

[45] Date of Patent: Jun. 13, 2000

[54] TENSION CONTROL DEVICE FOR PAPER WEB IN A ROTARY PRINTING MACHINE

[75] Inventors: Seiji Suzuki; Katsutoshi Suzuki, both of Yokohama, Japan

[73] Assignee: Kabushiki Kaisha Tokyo Kikai Seisakusho, Tokyo, Japan

[21] Appl. No.: 09/306,415

[22] Filed: May 6, 1999

[30] Foreign Application Priority Data

Nov. 25, 1998 [JP] Japan ..... 10-334003

[51] Int. Cl.[7] ..... B65H 23/06

[52] U.S. Cl. ..... 242/421.6; 242/554.5; 242/554.6

[58] Field of Search ..... 242/421.6, 554.5, 242/554.6

[56] References Cited

U.S. PATENT DOCUMENTS

| | | | |
|---|---|---|---|
| 2,965,326 | 12/1960 | Rockstrom | 242/421.6 X |
| 3,813,052 | 5/1974 | Swann et al. | 242/421.6 X |
| 4,000,865 | 1/1977 | Gaskins | 242/421.6 |
| 4,288,045 | 9/1981 | Romhild | 242/421.6 |
| 4,709,872 | 12/1987 | Hammer et al. | 242/421.6 |
| 5,186,409 | 2/1993 | Kansaku | 242/421.6 |

FOREIGN PATENT DOCUMENTS

| | | | |
|---|---|---|---|
| 61-44786 | 10/1986 | Japan . | |
| 5-45501 | 7/1993 | Japan . | |
| 1089340 | 11/1967 | United Kingdom | 242/554.5 |

*Primary Examiner*—Donald P. Walsh
*Assistant Examiner*—Minh-Chau Pham
*Attorney, Agent, or Firm*—Foley & Lardner

[57] ABSTRACT

A tension control device for paper web used in a rotary printing machine which includes paper rolls each of which has a brake mechanism varied in response to fluid pressure to splice to a new roll when a preceding roll reaches to a predetermined remain level, comprises; a tension detecting mechanism for detecting the magnitude of the tension applied to the paper web; a fluid pressure feeding system including at least three routes for feeding respective different pressures to the brake mechanisms; a first brake-force adjusting mechanism to provide a first pressure which is reduced as the tension applied to the paper web increases; a second brake-force adjusting mechanism to provide a second pressure which is reduced as the tension applied to the paper web increases and is greater than the first pressure; a first switching mechanism to switch the fluid pressure route in response to one of predetermined emergency signals; and a second switching mechanism for feeding a third pressure greater than the maximum of the second pressure in response to a splicing operation signal.

2 Claims, 1 Drawing Sheet

TENSION CONTROL DEVICE FOR PAPER WEB IN A ROTARY PRINTING MACHINE

BACKGROUND OF THE INVENTION

1. Field of the Invention

The present invention relates generally to a web-feed mechanism adapted for a rotary printing machine, and more particularly to a tension control device for stabilizing the tension applied to paper web fed from one of web-feed sections, which section is equipped with a specially designed brake system to feed continuously paper web from another web-feed section at the time when remaining roll of the previously working web-feed section reaches to a predetermined level.

2. Description of the Prior Art

Conventional tension control devices for stabilizing the tension applied to a paper web during a working state of a rotary printing machine have been disclosed in some publications such as Tokkosho 61-44786 (Japanese Patent Publication No. 44786/1986), referred to First Prior Art, and Tokkohei 5-45501 (Japanese Patent Publication No. 45501/1993), referred to Second Prior Art.

The tension control device according to the First Prior Art is associated with a paper feeding system which picks up a paper web from a web-feed section supported by a supporting section including a brake mechanism and feeds the web toward a printing section via guide rollers and floating roller(s). The floating roller is supported by an arm through a pivot, and a tension sensor is mounted on the pivot of the arm and connected to three different pneumatic systems. In detail, a first pneumatic system is actuated during a normal running stage, a second pneumatic system is actuated during a paper splicing stage, and a third pneumatic system is actuated during any emergencies. The first pneumatic system adjusts pneumatic pressure to be fed into the brake mechanism in response to the tension level detected by the sensor, and thus the brake mechanism comes into braking effect upon rotating motion of the web-feed section. The second pneumatic system includes a high pressure pneumatic reservoir which can store a predetermined high level of pneumatic pressure via a high pressure pneumatic valve for setting such predetermined high level pneumatic pressure, and feeds the same level pneumatic pressure as the predetermined high level pneumatic pressure into the brake mechanism through a booster relay in response to a signal from a cutter which works during a paper splicing stage. The third pneumatic system includes another high pressure pneumatic reservoir which can store predetermined high level of pneumatic pressure via an emergency stop control valve, and feeds in response to an emergency stop signal the same level pneumatic pressure as the predetermined high level pneumatic pressure stored in the reservoir into the brake mechanism through the booster relay. Thus one of these three pneumatic systems is automatically actuated and always applies a stable tension to the paper web fed from one of web-feeds toward the printing section.

The tension control device according to the Second Prior Art comprises a paper feeding means accompanying with a brake mechanism for braking the feeding motion of a web-feed, a tension sensor for detecting the tension level of the paper web fed from the web-feed, and a suppositive tension applying means for applying a suppositive tension to the tension sensor. The suppositive tension applying means applies such suppositive tension to the tension sensor during a paper leading operation and then the brake mechanism is actuated, so that the paper web leading from web-feed toward a printing section can be applied with the optimum tension.

Since the tension control device shown in the First Prior Art needs a plurality of pneumatic reservoirs, booster relay, double using of shuttle valves, and so on, such components configure a complicated pneumatic circuit which cannot quickly control the tension to be applied to the paper web. Further, during the paper leading operation prior to printing, the device shown in the First Prior Art must become temporarily ineffective to allow an operator to adjust the feeding speed of the paper web manually. This manual adjusting work reduces the efficiency of the whole of printing system.

Since the tension control device shown in the Second Prior Art includes a single pneumatic circuit for tension control which is commonly used for both normal working and paper splicing stages, the tension control cannot be effectively performed and thus the feeding tension after the paper splicing stage tends to fluctuate remarkably. This may cause various troubles such as loosening and breaking in running paper web. Further, since this second device uses means for applying a suppositive tension directly to a tension sensor, this applied suppositive tension must be gradually released from the tension sensor during paper web running operation after completion of paper leading operation in order to return the tension sensor to its normal detecting mode capable of detecting the actual tension applied to the running paper web. This transition is not a short period, so that the paper web fed within this transition may cause a great deal of spoilage. The device according to Second Prior Art should be improved in working efficiency to reduce a waste paper.

BRIEF SUMMARY OF INVENTION

In order to overcome these problems, it is a primary object of the present invention to provide an improved tension control device adapted for a rotary printing machine with a relatively simple construction which ensures printing work free from loosening and breaking in the paper web after pester, and a paper leading operation with keeping the optimum tension applied to the paper web.

To accomplish the above described object, according to the first aspect of the present invention, a tension control device for a paper web used in a rotary printing machine which includes a plurality of web-feeds each of which is provided with a paper roll and a brake mechanism whose braking force can vary in response to fluid pressure supplied from a pressure source and which can succeedingly perform splicing to a new roll when a preceding roll reaches to a predetermined remain level, comprises;

a tension detecting mechanism including a floating roller for guiding the paper web fed from one of the rolls, a single arm one end of which is pivotally supported by a pivot so as to move this arm angularly and the other end of which supports the floating roller rotatable, and a force applying means for applying a constant force to the single arm against the tension applied to the paper web so that the single arm can be moved angularly in response to the magnitude of the tension applied to the paper web;

a fluid pressure feeding conduit system including at least three upper conduits, a first upper conduit, a second upper conduit, and a third upper conduit, for feeding fluids having respective different pressures toward a lower conduit connected to the brake mechanisms associated with the paper rolls;

a first brake-force adjusting mechanism associated with the first upper conduit to make the output pressure out of this brake-force adjusting mechanism be a first pressure which is reduced as the tension applied to the paper web increases;

a second brake-force adjusting mechanism associated with the second upper conduit to make the output pressure out of this brake-force adjusting mechanism be a second pressure which is reduced as the tension applied to the paper web increases and is greater than the first pressure with respect to the same tension as the above;

a first switching mechanism arranged among the first upper conduit, the second upper conduit, and the lower conduit, to switch in response to one of predetermined emergency signals, from the first upper conduit to the second upper conduit to communicate between the second upper conduit and the lower conduit; and a second switching mechanism arranged between the lower conduit and the third upper conduit for feeding a third pressure greater than the maximum of the second pressure, and being located lower than the first switching mechanism, and actuated in response to a splicing operation signal to make the connection between the third upper conduit and the lower conduit available for only a predetermined period.

According to the second aspect of the present invention, a tension control device for a paper web used in a rotary printing machine which includes a plurality of web-feeds each of which is provided with a paper roll and a brake mechanism whose braking force can vary in response to fluid pressure supplied from a pressure source and which can succeedingly perform splicing to a new roll when a preceding roll reaches to a predetermined remain level, comprises;

a tension detecting mechanism including a floating roller for guiding the paper web fed from one of the rolls, a single arm one end of which is pivotally supported by a pivot so as to move the arm angularly and the other end of which supports the floating roller rotatable, and a force applying means for applying a constant force to the single arm against the tension applied to the paper web so that the single arm can be moved angularly in response to the magnitude of the tension applied to the paper web; a fluid pressure feeding conduit system including at least a first upper conduit, a second upper conduit, a third upper conduit, and a fourth upper conduit, for feeding fluids having respective different pressures toward a lower conduit connected to the brake mechanisms associated with the paper rolls;

a first brake-force adjusting mechanism associated with the first upper conduit to make the output pressure out of this brake-force adjusting mechanism be a first pressure which is reduced as the tension applied to the paper web increases;

a second brake-force adjusting mechanism associated with the second upper conduit to make the output pressure out of this brake-force adjusting mechanism be a second pressure which is reduced as the tension applied to the paper web increases and is greater than the first pressure with respect to the same tension as the above;

a first switching mechanism arranged among the first upper conduit, the second upper conduit, and the lower conduit, to switch in response to one of predetermined emergency signals, from the first upper conduit to the second upper conduit to communicate between the second upper conduit and the lower conduit;

a second switching mechanism arranged between the lower conduit and the third upper conduit for feeding a third pressure greater than the maximum of the second pressure, and being located lower than the first switching mechanism and actuated in response to a splicing operation signal to make the connection between the third upper conduit and the lower conduit available for only a predetermined period; and a third switching mechanism arranged between the lower conduit and the fourth upper conduit for feeding a fourth pressure smaller than the minimum of the first pressure, and being located lower than the first switching mechanism and actuated in response to a predetermined splicing operation signal to make the connection between the fourth upper conduit and the lower conduit available for only a predetermined period while the splicing operation signal is output.

The tension control device having the above described aspects can actually and quickly select the required switching mechanism under any conditions such as emergency, paper splicing operation, paper leading operation as well as a normal tension control operation for external pester and paper break so that the tension applied to the paper web can be automatically and always controlled to keep in the optimum level. Particularly, in splicing operation which requires to switch from the minimum brake force at the minimum roll diameter to the maximum brake force at the maximum roll diameter, the tension control device having the above described aspects can temporarily feed a higher fluid pressure to the brake mechanism within a short period required for following and dealing motion in a normal brake control operation to deal rapid changes, and therefore can automatically stabilize the tension applied to the paper web more quickly in comparison with conventional devices.

The above and further objects and novel features of this invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Figure 1:
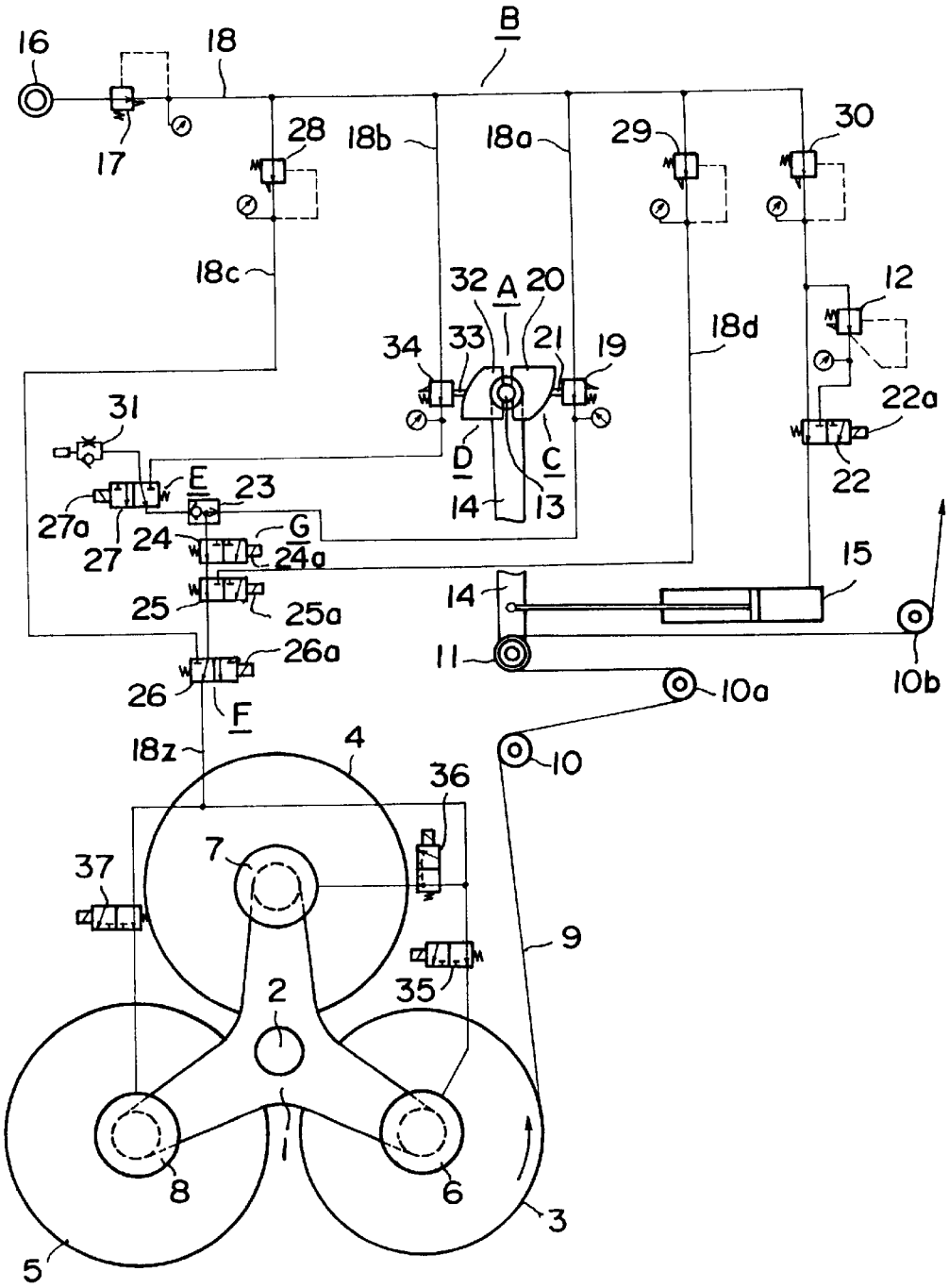
FIG. 1 is a schematic diagram of a fluid pressure circuit which is a typical embodiment of tension control device for a paper web used in a rotary printing machine according to the present invention.

Referring to FIG. 1, the fluid pressure circuit illustrated therein is an example of pneumatic pressure circuit embodied in a paper feeding section of a rotary printing machine. In the present invention, the fluid pressure contains other gas pressure and liquid pressure such as hydraulic and oil pressure.

A paper feeding section of a typical rotary printing machine includes a triradiate arm 1 which is rotatively supported by a center shaft 2. Each end of the triradiate arm 1 is assembled with a web-feed mechanism, not shown, for supporting a paper roll 3 (4, 5). The web-feed mechanism includes a brake mechanism 6 (7, 8) whose brake force is varied in response to the magnitude of pneumatic pressure fed to the brake mechanism so that feeding speed of the paper roll 3 (4, 5) can be controlled.

The paper feeding section further includes a plurality of guide rollers 10, 10*a*, 10*b*, and a floating roller 11 to guide the paper web 9 fed from the paper roll 3 towards a printing section, not shown. The floating roller 11 belongs to a tension detecting mechanism A. Additionally, this paper feeding section includes a paper splicing mechanism, not shown, and a tension control device according to the present invention. The paper splicing mechanism succeedingly splices a new roll 4 (5) to the preceding roll 3 (4) when remaining amount of this preceding roll 3 (4) reaches to a predetermined value, and cuts off the remaining paper of the preceding roll. The tension control device changes the pneumatic pressure fed to the brake mechanism 6 (7, 8) in response to the change of tension applied to the paper web 9 running from the paper roll 3 (4, 5) and a predetermined operation signal, to control the brake force for adjusting the feeding speed of the roll 3 (4, 5) in order to achieve the tension control on the running paper web 9.

The tension control device is composed of the above described tension detecting mechanism A, a fluid pressure feeding conduit system B, a first brake force adjusting mechanism C, a second brake force adjusting mechanism D, a first switching mechanism E, a second switching mechanism F, and a tension control mechanism G for paper leading.

The tension detecting mechanism A is so designed as to detect the tension applied to the paper web 9 running, and comprises the floating roller 11 for guiding the paper web 9 fed from the paper roll 3 (4, 5), a single arm 14 one end of which is pivotally supported by a pivot 13 so as to move the arm 14 angularly and the other end of which supports the floating roller 11 rotatable, and an air cylinder 15 as a force applying means for applying a constant force to the arm 14 against the tension applied to the paper web 9. Pneumatic pressure fed to the air cylinder 15 is adjusted by a regulator 30.

The fluid pressure feeding conduit system B shown in this embodiment uses pneumatic pressure and includes a conduit group 18 communicated between the brake mechanism 6 (7, 8) and a pneumatic pressure source 16 for feeding pneumatic pressure to the brake mechanism 6 (7, 8). In detail, the conduit group 18 contains first, second, third and fourth upper conduits 18*a*, 18*b*, 18*c* and 18*d* which are respectively connected to the pneumatic pressure source 16, and a lower conduit 18*z* connected to the brake mechanisms 6, 7 and 8, respectively. The conduit system B further includes a first regulator 17 for adjusting pneumatic pressure fed to the first and second upper conduits 18*a* and 18*b*, a second regulator 28 for adjusting pneumatic pressure fed to the third upper conduit 18*c*, and a third regulator 29 for adjusting pneumatic pressure fed to the fourth upper conduit 18*d*.

The first upper conduit 18*a* is provided with a first displacement-pneumatic pressure converter 19 in a normal running mode for the first brake force adjusting mechanism C. The second upper conduit 18*b* is also provided with a second displacement-pneumatic pressure converter 34 in an emergency stop mode for the second brake force adjusting mechanism D. By means of these displacement-pneumatic pressure converters 19 and 34, respective magnitudes A, B, C and D of pneumatic pressure fed to the lower conduit 18*z* through the upper conduits 18*a*, 18*b*, 18*c* and 18*d* are adjusted as the relation; C B A D. In a normal operation mode, the first upper conduit 18*a* and the lower conduit 18*z* are communicated.

The lower conduit 18*z* is branched at its lower end into three branch conduits which are connected respectively to the brake mechanisms 6, 7 and 8 mounted on the roll supporters. These branch conduits are further provided with electromagnetic valves 35, 36 and 37, respectively, to alternatively switch the branch conduits between open and close.

The first and second brake force adjusting mechanisms C and D are so arranged in the fluid pressure feeding conduit system B that they are actuated in linkage with the tension detecting mechanism A to change the pneumatic pressure fed to the brake mechanism 6 (7, 8) for adjusting its brake force.

The first brake force adjusting mechanism C includes a normal operation cam 20 which is angularly moved about the pivot 13 in linkage with the angular movement of the single arm 14, and the first displacement-pneumatic pressure converter 19 which is disposed in the first upper conduit 18*a* and actuated by the cam 20. In this embodiment, this converter 19 is a deceleration valve having a cam follower 21.

The second brake force adjusting mechanism D includes an emergency stop cam 32 which is shaped slightly different from the cam surface of the normal operation cam 20 and angularly moved about the pivot 13 in linkage with the angular movement of the single arm 14, and the second displacement-pneumatic pressure converter 34 which is disposed in the second upper conduit 18*b* and actuated by the cam 32. In this embodiment, this converter 34 is also a deceleration valve having a cam follower 33.

The first and second switching mechanisms E and F are arranged in the conduit system B and actuated in response to predetermined operation signals to switch selectively one of the upper conduits 18*a*, 18*b* and 18*c* to be communicated with the lower conduit 18*z*.

In detail, the first switching mechanism E is actuated in response to an emergency stop signal of this printing system and then the first upper conduit 18*a* is closed and the second upper conduit 18*b* is simultaneously opened to establish the communication with the lower conduit 18*z*. The first switching mechanism E includes an electromagnetic valve 27 which is actuated in response to predetermined emergency stop signals, and a shuttle valve 23, a throttle valve 31 and a solenoid 27*a* which are respectively moved in linkage with the motion of the valve 27.

The second switching mechanism F is actuated when the paper feeding section starts to splice the preceding roll to the succeeding roll, and then the third upper conduit 18*c* is opened for a predetermined period to establish the communication with the lower conduit 18*z*. The second switching mechanism F further includes an electromagnetic valve 26 and a solenoid 26*a* which are actuated in response to a cutting operation signal generated when the remaining paper of the preceding roll 3 is cut.

The tension control mechanism G includes a third switching mechanism for establishing the communication between the fourth upper conduit 18*d* and the lower conduit 18*z*, and controls the tension for leading the paper web 9 through the printing section of this rotary printing machine prior to the printing operation. This third switching mechanism is composed of two electromagnetic valves 24 and 25, and two solenoids 24*a* and 25*a* which are actuated in response to a signal representing paper leading operation.

Now, a series of operations with respect to the above described embodiment of the tension control device will be described.

During the running mode of the rotary printing machine, the paper web 9 must be always applied with the optimum tension which depends on a correlation between the rotating speed of a plate cylinder, not shown, of the rotary printing machine and the brake force against the rotating motion of the roll 3 (4, 5) for feeding the paper web 9.

FIG. 1 shows that the triradiate arm 1 supports at the top ends the paper roll 3 which now feeds the paper web 9, and the paper rolls 4 and 5 in their waiting positions. The paper web 9 fed from the roll 3 is traveled toward the printing section, not shown, through in order of the guide rollers 10 and 10*a*, the floating roller 11, and the guide roller 10*b*.

The brake mechanisms 6, 7 and 8 will generate respective brake forces in substantially proportion to the magnitude of pneumatic pressures fed to these mechanisms.

Since the floating roller 11 is mounted on the end of the single arm 14 which can be angularly moved about the pivot 13, the roller 11 will be also angularly moved counter-clockwise in FIG. 1 by the tension applied to the paper web 9. In order to apply counter-force against this tension, the center of the single arm 14 is connected to the rod end of the air cylinder 15 to apply a predetermined constant force generated by the air cylinder 15 to make the arm 14 turn clockwise in FIG. 1. The air cylinder 15 is supplied with pneumatic pressure from the pressure source 16 via the first regulator 17, the conduit 18, and the regulator 30. According to the above described configuration, the single arm 14 will be held in the angular phase which represents that the tension applied to the floating roller 11 is balanced with the pneumatic pressure adjusted by the regulator 30. This angular phase will be varied in accordance with various running modes of the paper web 9.

The tension applied to the paper web 9 is generated between the stretching force by the plate cylinder of the printing section and the brake force applied to the roll 3, and will be increased as the brake force greater. Accordingly, this tension can be stabilized by keeping the magnitude of pneumatic pressure to be fed to the brake mechanisms 6, 7 and 8 be controlled substantially inverse proportion to the magnitude of the tension applied to the paper web 9.

Thus the first displacement-pneumatic pressure converter 19 is actuated in linkage with the angular motion of the single arm 14. As described above, the pivot 13 of the single arm 14 for supporting the floating roller 11 is provided at the right side in FIG. 1 with the normal operation cam 20 having a cam surface gradually enlarging from the bottom to the top. The cam follower 21 follows the angular motion of the single arm 14 in accordance with the change in the tension applied to the paper web 9, and thus the open degree of the first displacement-pneumatic pressure converter 19 is adjusted.

As shown in the pneumatic pressure circuit diagram in FIG. 1, the pneumatic pressure is fed from the pressure source 16 to the first displacement-pneumatic pressure converter 19 through the first regulator 17, the conduit 18, and the first upper conduit 18*a*. Further the pneumatic pressure output from the converter 19 is fed to the brake mechanism 6 (7, 8) through the shuttle valve 23 which is a part of the first switching mechanism E, and the lower conduit 18*z*.

In the tension control device as described above, when the paper web 9 is loosened, the single arm 14 is angularly moved clockwise in FIG. 1 by the bias force generated by the air cylinder 15. According to this clockwise movement, the normal operation cam 20 is also turned clockwise and thus the first converter 19 gradually increases the pneumatic pressure to be fed to the brake mechanism 6 (7, 8). As the brake force is increased, the feeding motion of the paper web 9 from the roll 3 (4, 5) is restricted. On the other hand, when the paper web 9 is stretched, the single arm 14 is angularly moved counter-clockwise in FIG. 1 by this stretching force. According to this angular movement, the normal operation cam 20 is also turned counter-clockwise and thus the first converter 19 gradually decreases the pneumatic pressure to be fed to the brake mechanism 6 (7, 8). As the brake force is decreased, the paper web 9 can be easily fed from the roll 3 (4, 5). Consequently, the paper web 9 is always applied with a stable tension in the above described automatic control manner.

When the rotary printing machine is subjected to any troubles, this machine suddenly stops. The paper roll 3 (4, 5), however, releases the paper web 9 for a while on account of the inertial force. In order to deal for emergency stop, the brake mechanism 6 (7, 8) needs substantially twice brake force to suddenly stop the paper roll 3 (4, 5).

In the embodiment according to the present invention, since the paper roll 3 releases the paper web 9 on account of the inertial force in case of emergency stop, the tension applied to the paper web 9 gradually decreases. Then the single arm 14 is angularly moved clockwise in FIG. 1 by the predetermined bias force generated by the air cylinder 15. On the other way, the solenoid 27*a* is energized in response to the emergency stop signal from the printing section, not shown. The electromagnetic valve 27 of the first switching mechanism E is actuated by this solenoid 27*a*, and then the communication between the second upper conduit 18*b* and the lower conduit 18*z* is established. On the same occasion, the emergency stop cam 32 is angularly moved clockwise in FIG. 1 by the angular clockwise motion of the single arm 14. In the tension control device as described above, when the paper web 9 is loosened, the single arm 14 is angularly moved clockwise in FIG. 1 by the bias force generated by the air cylinder 15. According to this clockwise movement, the normal operation cam 20 is also turned clockwise and thus the first converter 19 gradually increases the pneumatic pressure to be fed to the brake mechanism 6 (7, 8). As the brake force is increased, the feeding motion of the paper web 9 from the roll 3 (4, 5) is restricted. On the other hand, when the paper web 9 is stretched, the single arm 14 is angularly moved counter-clockwise in FIG. 1 by this stretching force. According to this angular movement, the second displacement-pneumatic pressure converter 34 gradually increases the pneumatic pressure to be fed to the brake mechanism 6 (7, 8). As the brake force is increased, the paper feeding motion of the paper web 9 from the roll 3 is restricted.

The emergency stop cam 32 has a cam surface slightly different from that of the normal operation cam 20 so that the second converter 34 actuated through the cam follower 33 can feed substantially twice pneumatic pressure to the brake mechanism 6 (7, 8) in comparison with the case of the normal operation cam 20. As a-result, the brake mechanism 6 (7, 8 can generate substantial twice brake force.

On the other hand, when the paper web 9 is stretched again, the single arm 14 is angularly moved counter-clockwise in FIG. 1 by this stretching force. According to this angular movement, the emergency stop cam 32 is also turned counter-clockwise and thus the second converter 34 gradually decreases the pneumatic pressure to be fed to the brake mechanism 6 (7, 8). As the brake force is decreased, the paper web 9 can be easily fed from the roll 3 (4, 5). Consequently, the emergency stop operation of the paper roll 3 (4, 5) has been performed with preventing the paper roll 3 (4, 5) from paper releasing in the above described automatic control manner.

The solenoid 27*a* is dis-energized in response to the signal generated when the emergency stop operation has been completed. Then the electromagnetic valve 27 of the first switching mechanism E is switched to allow the increased pneumatic pressure to be released into the ambient air through the throttle valve 31. Whenever this increased pneumatic pressure becomes lower than the pneumatic pressure output of the first displacement-pneumatic pressure converter 19, the shuttle valve 23 is switched to allow the converter 19 to feed the output pneumatic pressure to the lower conduit 18*z*. Finally, the paper web 9 and the paper roll 3 (4, 5) have been already set to restart the printing operation.

In order to begin paper leading operation prior to the printing operation in this rotary printing machine, the brake force for the brake mechanism 6 (7, 8) should be firstly decreased to pull out the paper web 9 from the paper roll 3 (4, 5). As a paper leading switch, not shown, is turned on, the solenoid 24*a* is energized by a paper leading signal from this switch. Then the electromagnetic valve 24 of the third switching mechanism in the tension control mechanism G makes the first upper conduit 18*a* close and allows the pneumatic pressure in the lower conduit 18*z* to be released into the ambient air. On the same occasion, the solenoid 25*a* is also energized to switch the electromagnetic valve 25 to establish the communication between the fourth upper conduit 18*d* and the lower conduit 18*z*. Thus the lower pneumatic pressure out of the regulator 29 is fed to the brake mechanism 6 (7, 8) so that the brake force of the brake mechanism 6 (7, 8) can be decreased to realize the optimum tension level for paper leading operation. As the paper leading operation has been completed, the paper leading signal is vanished. Then the solenoids 24*a* and 25*a* are both switched to release the electromagnetic valves 24 and 25. According to this switching motion, the first upper conduit 18*a* for the normal operation becomes alive to reset this printing system into its standby mode.

As the diameter of the paper roll 3 (4, 5) now on feeding operation becomes smaller, it should be spliced with the succeeding roll 4 (5, 3) having the greater diameter. Upon splicing, the tension applied to the paper web 9 fluctuates remarkably and thus conventional devices need a relatively long period to stabilize the tension. The tension control device according to the present invention can minimize such fluctuation of the tension applied to the paper web 9 and further quickly and easily performs an automatic tension control and stabilizing operation by only automatically working the pneumatic pressure control system.

Since the diameter of the preceding roll 3 (4, 5) becomes the minimum size at the stage immediately before the splicing operation, the inertial force applied to the preceding roll 3 (4, 5) also becomes minimum. Accordingly, a small brake force can realize a sufficient tension applied to the paper web 9. The single arm 14 is angularly moved counterclockwise in FIG. 1 and the cam follower 21 is in contact with the narrow section of the normal operation cam 20. As a result, the first displacement-pneumatic pressure converter 19 generates the reduced pneumatic pressure.

Upon splicing, the paper web 9 is spliced on the instant from the smallest roll 3 (4, 5) to the greater roll 4 (5, 3) and then the paper web 9 is fed from the greater roll 4 (5, 3). Since the greater roll 4 (5, 3) is subjected to a greater inertial force, the brake force required to the brake mechanism 6 (7, 8) should be instantly changed from the minimum to the maximum. This changing speed is so fast that the brake force can not be adequately controlled through the first and second displacement-pneumatic pressure converters 19 and 34.

In order to follow this splicing operation, the succeeding roll 4 (5, 3) is driven by any conventional roll driver, not shown, so as to coincide the circumferential speed of the succeeding roll with the running speed of the paper web 9 fed from the preceding roll 3 (4, 5) and then the paper web 9 is forcibly brought into contact with the circumferential surface of the succeeding roll 4 by a conventional splicing mechanism, not shown. The preceding paper web is bonded to the forward end of the succeeding paper web by means of any adhesive. On the same occasion, a conventional cutting means cuts the portion of the preceding paper web 9 between the spliced section and the preceding roll 3 (4, 5). In response to the cutting signal output from this cutting means, the brake force fed to the brake mechanism 6 (7, 8) is instantly increased for a predetermined period.

In this embodiment shown in FIG. 1, the solenoid 26*a* is energized in response to this cutting signal, and thus the electromagnetic valve 26 of the second switching mechanism F is switched to establish the communication between the third upper conduit 18*c* and the lower conduit 18*z*. The increased pneumatic pressure adjusted by the regulator 28 is fed to the brake mechanism 7 (6, 8) of the succeeding roll 4 (5, 3) through the electromagnetic valve 36, and then the succeeding roll 4 (5, 3) is instantly restricted by the great brake force.

The solenoid 26*a* is automatically dis-energized after a predetermined period by a timer, not shown, and thus the electromagnetic valve 26 is returned to the initial position shown in FIG. 1. In this initial position, the first upper conduit 18*a* is communicated with the lower conduit 18*z* and the increased pneumatic pressure is introduced into the first upper conduit 18*a*. Then the normal operation pneumatic pressure circuit composed of the first upper conduit 18*a* and the lower conduit 18*z* acts as the automatic tension control.

As described above, in this embodiment of the tension control device according to the present invention, upon splicing operation, the increased pneumatic pressure is fed to brake mechanism 6 (7, 8) for one second, as an example, to temporarily maintain the great brake force. During such period, the normal operation state is recovered and reset to begin a normal printing operation. Accordingly, this system can stabilize the tension applied to the paper web 9 within an extremely short period in comparison with conventional systems even when the maximum fluctuation of the brake force occurs.

In FIG. 1, a regulator 12 and an electromagnetic valve 22 with a solenoid 22*a* configure a pneumatic circuit arranged between the regulator 30 and the air cylinder 15, which circuit becomes effective for using another paper roll having different width.

As given explanation above, the tension control device having the above described aspect can actually and quickly select required switching mechanism under any conditions such as emergency, paper splicing operation, paper leading operation as well as ordinarily tension control operation for external pester and paper break so that the tension applied to paper web can be automatically and always controlled to keep in the optimum level. Particularly, in splicing operation which requires to switch from the minimum brake force at the minimum roll diameter to the maximum brake force at the maximum roll diameter, the tension control device having the above described aspect can temporarily feed a higher fluid pressure to the brake mechanism within a short period required for following and dealing motion in a normal brake control operation to deal rapid changes, and therefore can automatically stabilize the tension applied to paper web more quickly in comparison with conventional devices.

The tension control device according to the present invention ensures a continuous printing operation free from stopping owing to loosening and breaking in paper web, and a paper leading operation with keeping the optimum tension applied to the paper web.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. In a rotary printing machine which includes a plurality of web-feeds each of which is provided with a paper roll (3, 4, 5) and a brake mechanism (6, 7, 8) whose braking force can vary in response to fluid pressure supplied from a pressure source (16) and which can succeedingly perform splicing to a new roll (4, 5 or 3) when a preceding roll (3, 4 or 5) reaches to a predetermined remain level, a tension control device comprising;

a tension detecting mechanism (A) including a floating roller (11) for guiding paper web (9) fed from one of the rolls (3, 4, 5), a single arm (14) one end of which is pivotally supported by a pivot (13) so as to move said arm (14) angularly and the other end of which supports said floating roller (11) rotatable, and a force applying means for applying a constant force to said single arm (14) against the tension applied to said paper web (9) so that said single arm (14) can be moved angularly in response to the magnitude of the tension applied to the paper web (9);

a fluid pressure feeding conduit system (B) including at least three upper conduits, a first upper conduit (18*a*), a second upper conduit (18*b*), and a third upper conduit (18*c*) for feeding fluids having respective different pressures towards a lower conduit (18*z*) connected to the above mentioned brake mechanisms (6, 7, 8) associated with the above mentioned paper rolls (3, 4, 5);

a first brake-force adjusting mechanism (C) associated with the above mentioned first upper conduit (18*a*) to make the output pressure out of this brake-force adjusting mechanism (C) be a first pressure which is reduced as the tension applied to the paper web (9) increases;

a second brake-force adjusting mechanism (D) associated with the above mentioned second upper conduit (18*b*) to make the output pressure out of this brake-force adjusting mechanism (D) be a second pressure which is reduced as the tension applied to the paper web (9) increases and is greater than the above mentioned first pressure with respect to the same tension as the above;

a first switching mechanism (E) arranged among the above mentioned first upper conduit (18*a*), the above mentioned second upper conduit (18*b*), and the above mentioned lower conduit (18*z*), to switch in response to one of predetermined emergency signals from said first upper conduit (18*a*) to said second upper conduit (18*b*) to communicate between said second upper conduit (18*b*) and said lower conduit (18*z*); and a second switching mechanism (F) arranged between the above mentioned lower conduit (18*z*) and the above mentioned third upper conduit (18*c*) for feeding a third pressure greater than the maximum of the second pressure, said second switching mechanism (F) being located lower than the above mentioned first switching mechanism (E), and actuated in response to a splicing operation signal to make the connection between said third upper conduit (18*c*) and said lower conduit (18*z*) available for only a predetermined period.

2. The tension control device according to claim 1 further comprising a tension control mechanism (G) for paper leading operation, including a third switching mechanism arranged between the above mentioned lower conduit (18*z*) and a fourth upper conduit (18*d*) for feeding a fourth pressure smaller than the minimum of the above mentioned first pressure, and located lower than the first switching mechanism, said third switching mechanism being actuated in response to a predetermined splicing operation signal to make the connection between said fourth upper conduit (18*d*) and said lower conduit (18*z*) available for only a predetermined period while the splicing operation signal is output.

* * * * *